US005560089A

United States Patent [19]

Morita

[11] Patent Number: 5,560,089

[45] Date of Patent: Oct. 1, 1996

[54] FASTENER MEANS

[75] Inventor: Tamao Morita, Tokyo, Japan

[73] Assignee: Tarmo Co. Ltd., Tokyo, Japan

[21] Appl. No.: 288,249

[22] Filed: Aug. 9, 1994

[30] Foreign Application Priority Data

Aug. 9, 1993 [JP] Japan ..... 5-217057

[51] Int. Cl.[6] ..... A44B 21/00

[52] U.S. Cl. ..... 24/303; 24/66.1

[58] Field of Search ..... 24/303, 49 M, 24/94; 292/251.5; 335/285

[56] References Cited

U.S. PATENT DOCUMENTS

| | | | |
|---|---|---|---|
| 2,798,241 | 7/1957 | Cohen | 24/303 |
| 3,749,301 | 7/1973 | Peckar | 24/303 |
| 5,042,116 | 8/1991 | Ossiani | 24/303 |
| 5,125,134 | 6/1992 | Morita | 24/303 |
| 5,208,951 | 5/1993 | Aoki | 24/303 |

FOREIGN PATENT DOCUMENTS

| | | | |
|---|---|---|---|
| 0112304 | 7/1983 | Japan | 335/285 |
| 0147510 | 7/1986 | Japan | 335/285 |

*Primary Examiner*—Victor N. Sakran
*Attorney, Agent, or Firm*—Pennie & Edmonds

[57] ABSTRACT

The present invention relates to a fastener means comprising an attracting member A with a permanent magnet 1 and an attracted member B with a ferromagnetic element 110 to be attracted by the former member. To assure easy and stable attraction between the members A and B when they are respectively fixed to a pair of objects C and C' disposed in an intersecting relation, the members A and B include planes and e' that are parallel to each other when the members are attracted. Alternatively, the main attraction surfaces a' and/or b' of the members A and B include a plane d and/or d' within a virtual plane D that intersects the fixing surfaces of the objects, or the attracting member A and/or the attracted member B are fixed to the object with an inclination, so that the members A and B can be held stably attracted to each other without being subject to external force.

7 Claims, 10 Drawing Sheets

FASTENER MEANS

BACKGROUND OF THE INVENTION

1. Field of the Invention

The present invention relates to an improvement of a fastener means comprising an attracting member having a permanent magnet and an attracted member having a ferromagnetic element to be attracted by said attracting member. More particularly, it relates to a fastener means wherein surfaces of the attracting and the attracted members run parallel to each other even when the surfaces of the objects to which said members are attached are not parallel to each other.

2. Prior Art

Prior art fastener means comprises, for example as shown in FIGS. 16 through 18, an attracting member having a permanent magnet and an attracted member having a ferromagnetic element to be attracted by said permanent magnet, and is used to close the opening of bags, sacks, pocketbooks, handbags and brief cases. As the attracted member N is attracted by the attracting member M by the force of the permanent magnet 300 of the member M, the members M and N must be attached to surfaces T and T' respectively of an object in such a manner that the attracting surface m and the attracted surface n respectively thereof are in close contact with each other, as shown in FIG. 16.

In the fastener means shown in FIG. 16, the surfaces m and n respectively of the member M with the permanent magnet 300 and the member N with the ferromagnetic element 301 are brought in contact without gap in between, so that the magnetism of the permanent magnet 300 constituting the member M is guided toward the ferromagnetic element 301 of the member N under minimum reluctance for effective attraction. The close contact between the surfaces m and n of the members M and N, or that the members M and N are attached to the objects T and Tn' to parallelize the two surfaces m and n, is essential for this type of fastener means.

However, two things are rarely parallelized in practice when they are to be fastened by a fastener means. As shown in FIG. 17, the surfaces t and t' of the objects T and T' to which the members M and N are attached are often not parallel to each other. For example, the opposing surfaces at the opening of a bag, the cover of a handbag and the opposing surface of the body, or the surface of a door frame and that of the door which closes the door frame usually oppose each other at a given inclination, and the member N is often attracted to the member M in an inclined state.

When the surfaces t and t' of the objects T and T' respectively on which the members M and N are attached are not parallel to each other, their respective surfaces m and n are abutted against each other at an inclination that corresponds to the inclination occurring between the surfaces t and t'. This means that a space S is formed between the surfaces m and n when the two members M and N are attracted to each other to be in what is substantially called a point contact or a line contact.

Generally, a permanent magnet functions most efficiently when there is minimum reluctance between the permanent magnet and a substance such as ferromagnetic element which is to be attracted by the magnet. Thus, when there is a space S between the attracting member M and the attracted member N as shown in FIG. 17, it is defective in that magnetism of the permanent magnet 300 cannot be effectively utilized for attracting the member N.

When the surfaces L and t' of the objects T and T' to which the members M and N are to be attached are not parallel to each other as shown by the solid line in FIG. 18, it becomes difficult to maintain a planar contact of the member M with the member N in case an impact is applied on the objects T and T' even if they are fastened by the attraction of the member N to the member M by bringing the member N in close contact with the member M, as shown by the dot-and-chain in FIG. 18. Moreover, when applied with such impact, the members M and N are inconveniently brought to the state shown by the solid line in FIG. 18.

OBJECTS OF THE INVENTION

The present invention aims at obviating inconveniences encountered in the prior art fastener means by providing a fastener means capable of secure fastening performance even when the surfaces to which the component parts of the fastener means are attached are not parallel, said fastener means being characterized in that:

an attracting member and an attracted member of a fastener means each includes a plane that runs parallel to the other when said members are attracted even if they are attached to nonparallel surfaces of a pair of objects. Alternatively, a fastener means may be such that the main attraction surface(s) of the attracting and/or attracted member(s) runs on a virtual plane that intersects the surface(s) of an object(s) to which the member ( s ) is attached; or said attracting and/or attracted member(s) is attached to the surface(s) of the object(s) with an inclination.

Thus, the first object of the present invention is to provide a fastener means comprising an attracting member and an attracted member that can be easily brought into close contact with a small force even when the surfaces of a pair of objects to which component parts are attached intersect with each other.

The second object of the present invention is to provide a fastener means comprising an attracting member and an attracted member that can be stably held in close contact with each other without being subject to obliquely acting external force even when the surfaces of a pair of objects to which the component parts are attached intersect with each other.

Still another object of the present invention is to provide a fastener means comprising an attracting member and an attracted member of extremely simple construction that can hold intersecting surfaces of a pair of objects tightly fastened with ease and without trouble.

Still another object of the present invention is to provide a fastener means that can fasten a pair of objects without causing the object surfaces to be distorted or unnaturally bent.

Other objects of the present invention will become apparent from the following description.

SUMMARY OF THE INVENTION

The fastener means according to the first invention comprises an attracting member A with a permanent magnet 1 and an attracted member B with a ferromagnetic element 110 to be attracted by the attracting member A. The fastener means is so constructed that a pair of objects C and C' can be fastened even when the surface c of the object C to which the member A is attached and the surface c' of the object C' to which the member B is attached are not parallel to each other when the members A and B are attracted. The fastener means is characterized in that the surface a of the member A and the surface b of the member B become parallel planes e, e' when the member B is attracted by the member A.

Thus, with this fastener means, the parallel surfaces e and e' of the attraction surfaces a and b constituting the fastener means assure stable contact even when the opposing surfaces c and c' of the objects C and C' are not parallel.

The fastener means according to the second invention comprises an attracting member A with a permanent magnet 1 and an attracted member B with a ferromagnetic element 110 and is characterized in that:

the members A and B are attached to surfaces c and c' of a pair of objects C and C' respectively;

the main attraction face a' of the member A includes a plane d on a virtual plane D that intersects the surface c of the object C to which the member A is attached; or, the main attraction face b' of the member B includes a plane d' on a virtual plane D' that intersects the surface c' of the object C' to which the member B is attached; or the main attraction surface a' of the member A and the main attraction surface b' of the member B include planes d and d' respectively on the virtual planes D and D' that intersect the surfaces c and c' of the pair of objects C and C' to which the members A and B are attached.

Thus, with this fastener means, the plane d on the virtual plane D of the member A attracts the surface b of the member B with ease, or alternatively the plane d' on the virtual plane D' in the member B is attracted to the surface of the member A with ease, or still alternatively the planes and d' on the respective virtual planes may be attracted without difficulty.

The fastener means according to the third invention comprises an attracting member A with a permanent magnet 1 and an attracted member B with a ferromagnetic element 110 to be attracted to the member A and which is characterized in that:

the members A and B are attached to the surfaces c and c' of a pair of objects C and C'; and the attracting member A is attached with an inclination to said object C; or the attracted member B is attached with an inclination to said object C'; or the members A and B are attached respectively to said objects C and C' with an inclination.

Thus, with this fastener means, even when the opposing surfaces c and c' of the pair of objects C and C' respectively to which the members A and B are attached are not parallel, the member A easily attracts the member B with due inclination that corresponds to the inclination of the member(s) A and/or B as against the object(s) C and/or C'.

BRIEF DESCRIPTION OF THE DRAWINGS

FIGS. 1 through 3 show the basic Embodiments 1 through 3; and FIGS. 4 through 6 Embodiments 4 through 6 with additional fixing means.

FIG. 7 is a partially exploded perspective view of a handbag, while FIG. 8 is a side view to show the essential parts of the handbag.

The fastener means shown in FIGS. 9 through 15 are the embodiments adapted for particular uses such as for closing the opening of bags, etc., closing the cover of handbags, brief cases or boxes, closing the opening of a cabinet or entrance door, fastening bands and belts, or fastening clothes such as jackets and coats as a substitute for button.

Figure 9B:
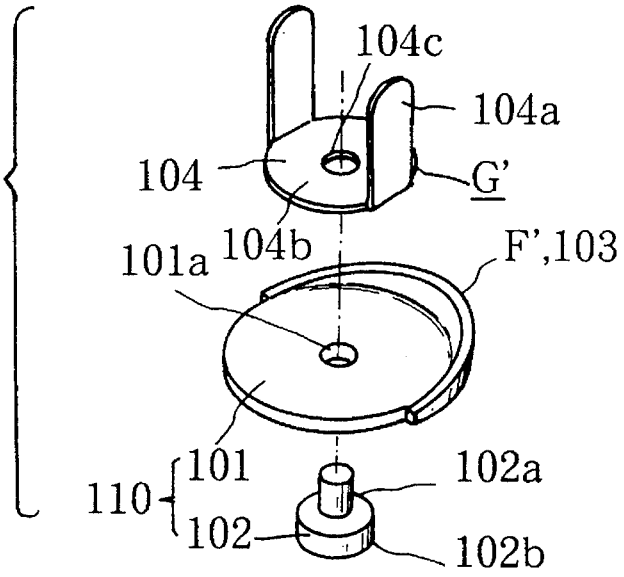
Figure 9A:
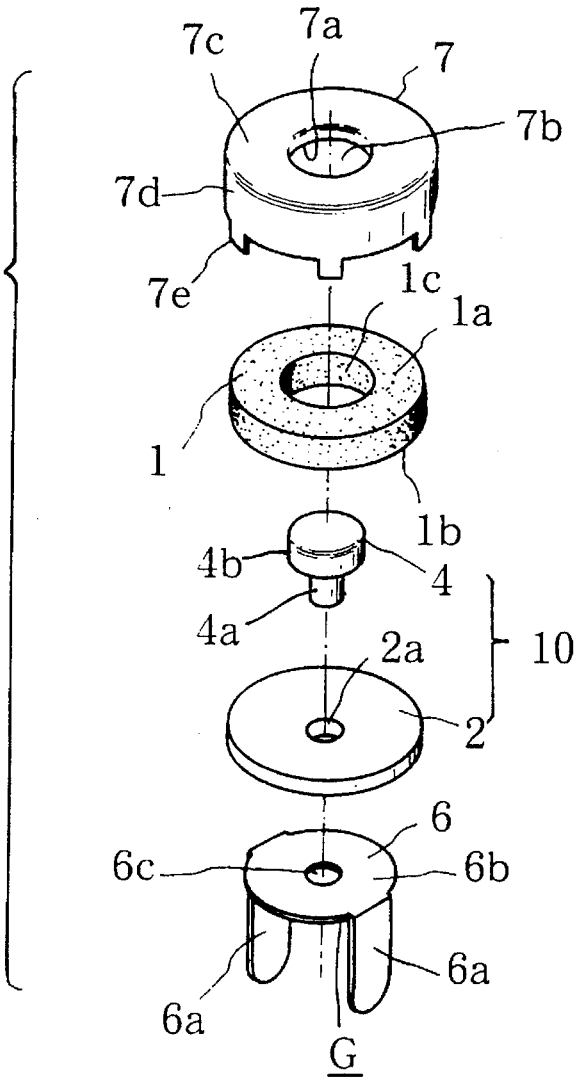
Figure 10:
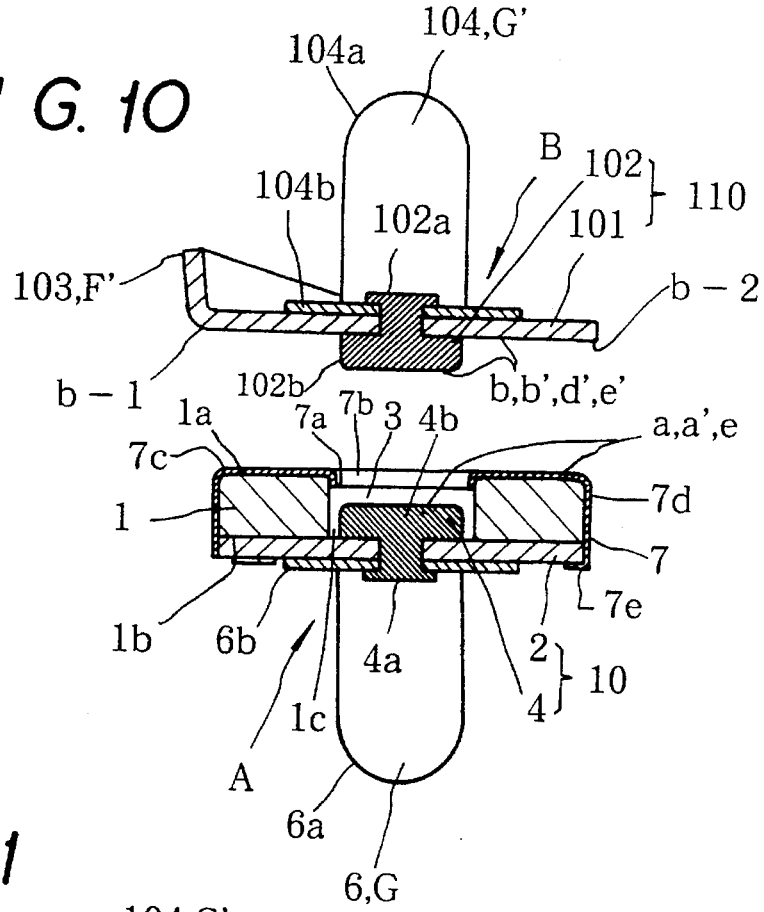
Figure 11:
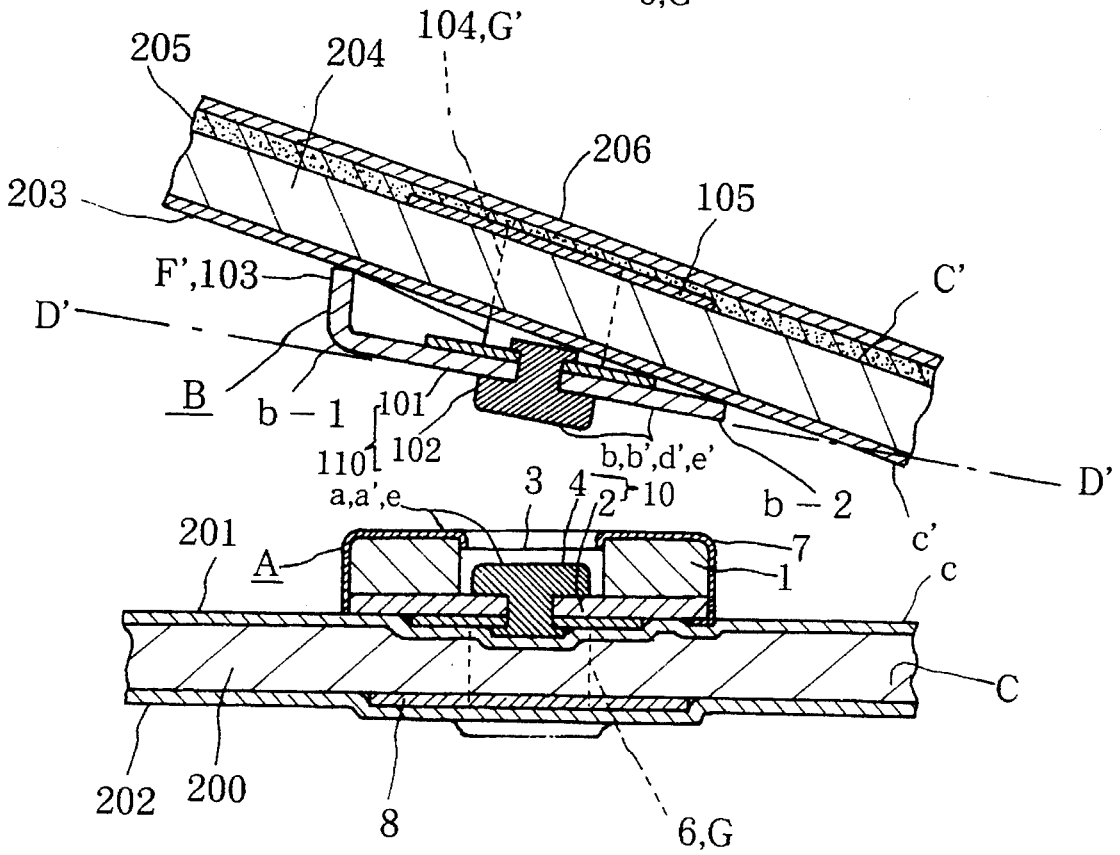
Figure 12:
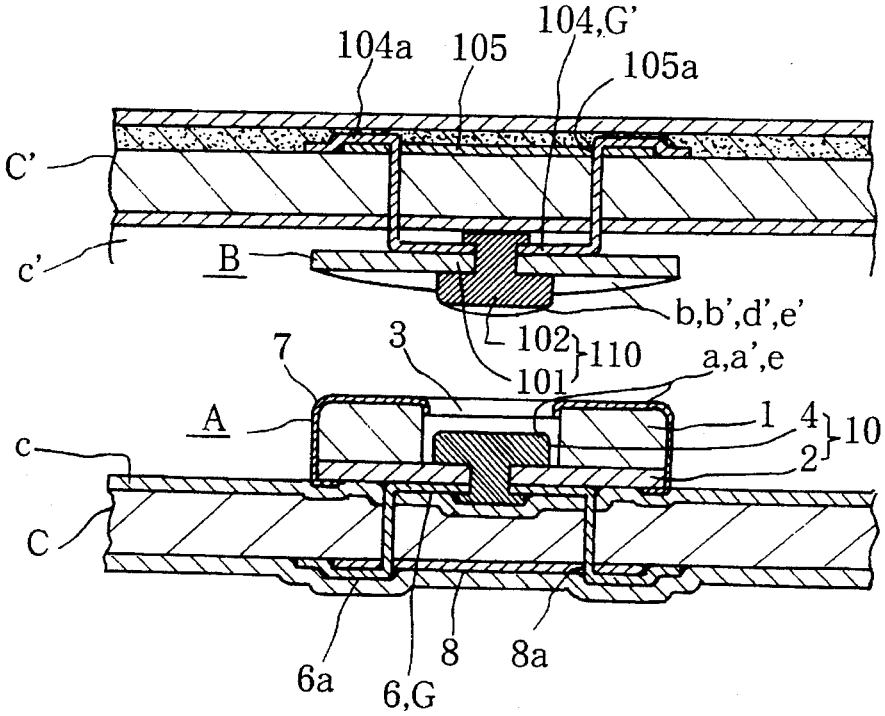
Figure 13:
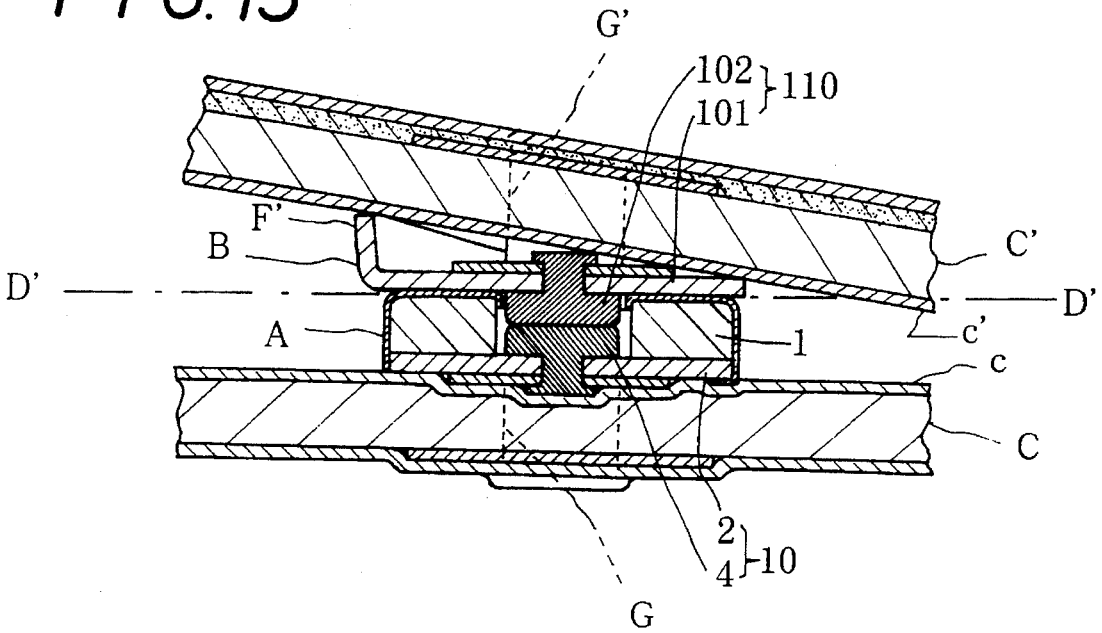

FIG. 9 through 13 show a fastener means according to Specific Example 1. FIG. 9 is a perspective view to show the component parts when disassembled. FIG. 10 is a sectional view to show the male and the female fastener means comprising said component parts when they are not engaged. FIGS. 11 and 12 are sectional views taken in different directions to respectively show the fastener means when attached to the objects C and C'. FIG. 13 is a sectional view taken in the same direction as that of FIG. 11 to show the engagement of the male and the female fastener means attached to the objects C and C'.

Figure 14B:
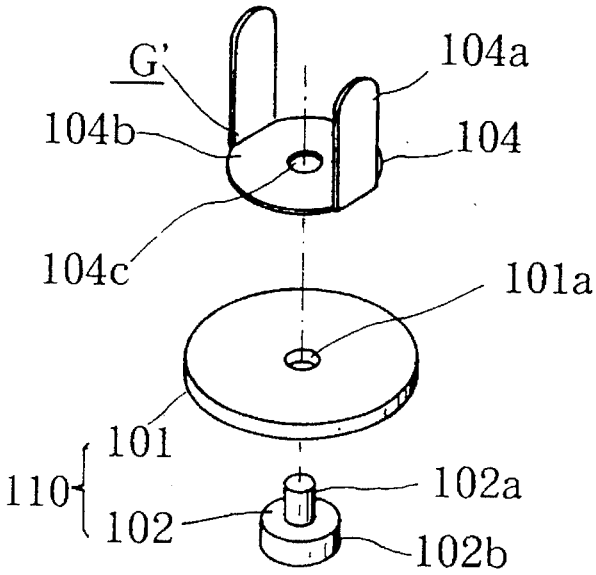
Figure 14A:
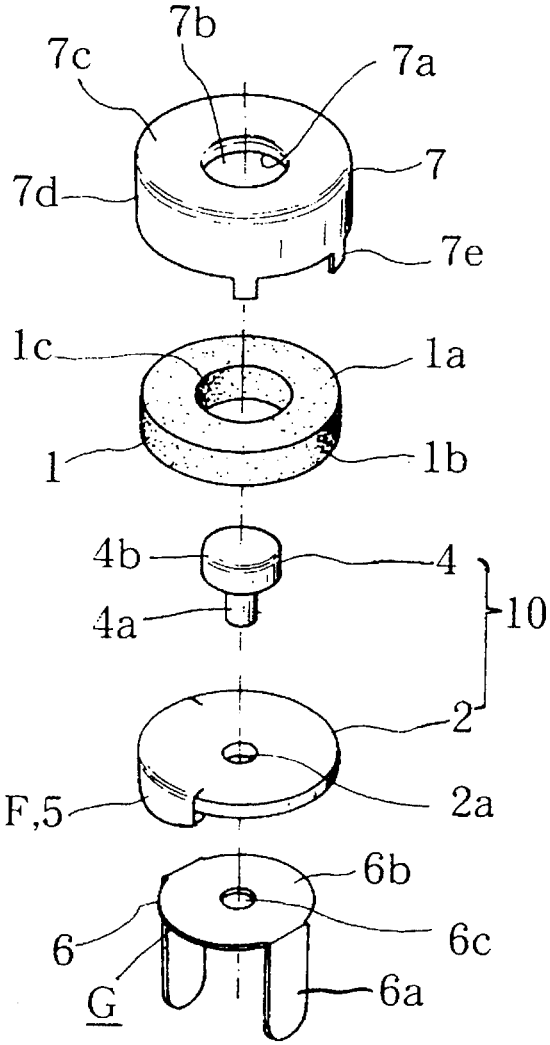
Figure 15:
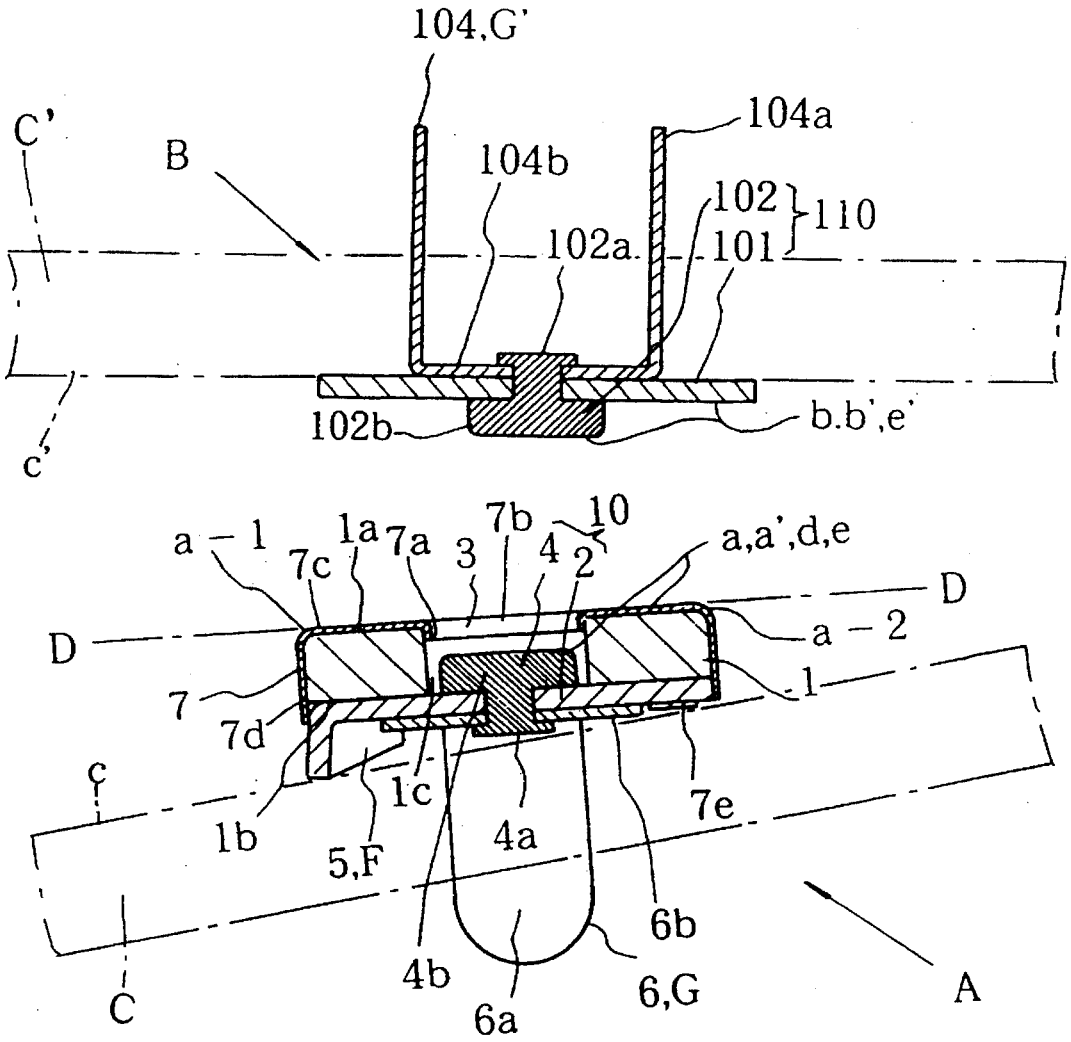

FIGS. 14 and 15 show another fastener means according to Specific Example 2. FIG. 14 is a perspective view to show the component parts when disassembled, and FIG. 15 a sectional view of the attracting member A and the attracted member B comprising said component parts when they are not engaged.

Figure 16:
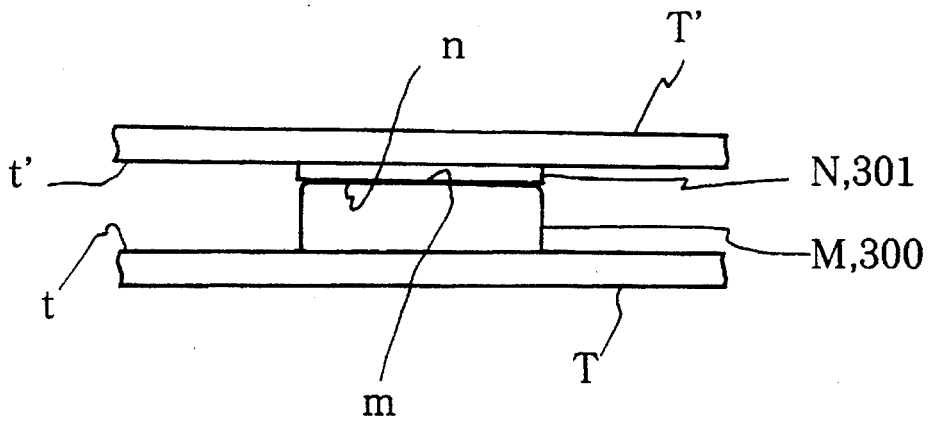
Figure 17:
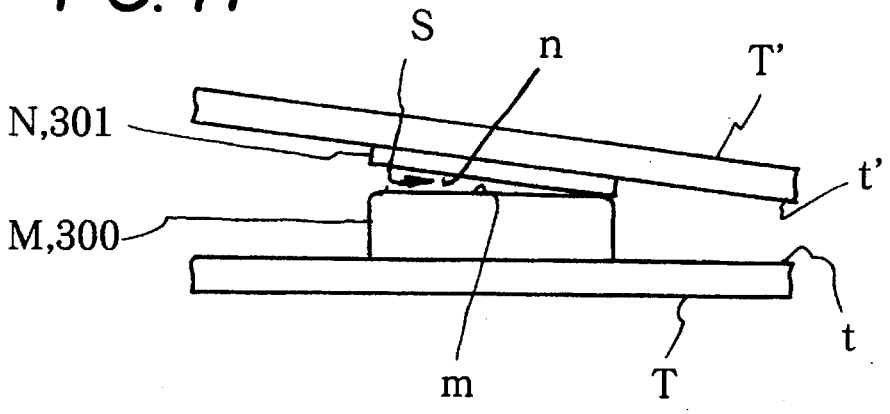
Figure 18:
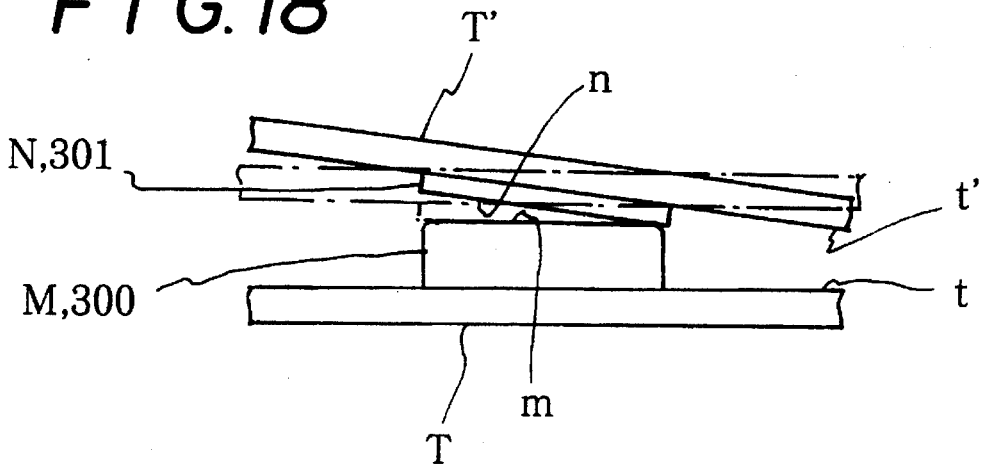

FIGS. 16, 17 and 18 show side views of the prior art fastener means as described above.

DETAILED DESCRIPTION OF THE INVENTION

Typical embodiments and specific examples of the present invention will now be described in more detail referring to the attached drawings. In the explanation of the drawings below, component parts that are identical or substantially identical are given the same reference numbers and explanation is omitted.

It should be noted that embodiments and specific examples are given by way of examples and they do not limit the present invention in any way.

<Fastener Means According to the First Invention> Embodiments 1 through 3 according to the first invention will now be described referring to FIGS. 1 through 3. The fastener means according to Embodiments 1 through 3 comprise an attracting member A with a permanent magnet 1 and an attracted member B with a ferromagnetic element 110 to be attracted by the member A. The members A and B are attached to objects C and C' and are so constructed that, when the members A and B are attracted to each other for engagement, the opposing surfaces c and c' of the objects C and C' to which A and B are fixed are on non-parallel planes and that the attraction surfaces a and a' of A and B respectively include planes e and e' that run parallel to each other.

It should be noted that said parallel surfaces e and e' may each be a generally flat surface. Alternatively, either one of the surfaces may be a concave surface while the other a complementary convex, or a conical frustum and a complementary funnel shape, or both being flat but slanted at an equal angle, so long as the two surfaces e and e' come in close contact with each other.

Alternatively still, the surfaces e and e' may be a combination of two or more different planes such as flat, curved or inclined surfaces, or planes that include any one or a combination of said different types of surfaces.

The surface e on the attraction surface a of the member A may cover either the entire area or a part of the surface a. Likewise, the surface e' on the attraction surface b of the member B may cover either the entire area or a part of the surface b.

Figure 1:
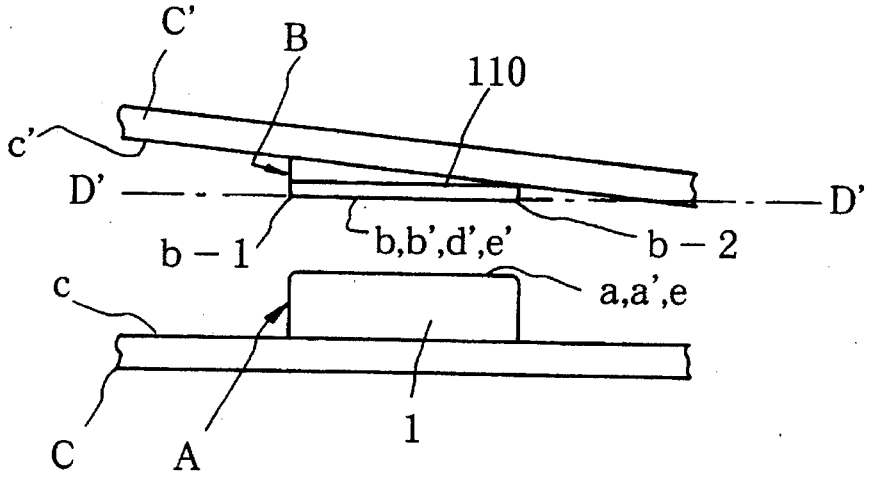
FIGS. 1 through 6 show a typical fastener means embodying the present invention in schematic diagrams to facilitate understanding.
Figure 2:
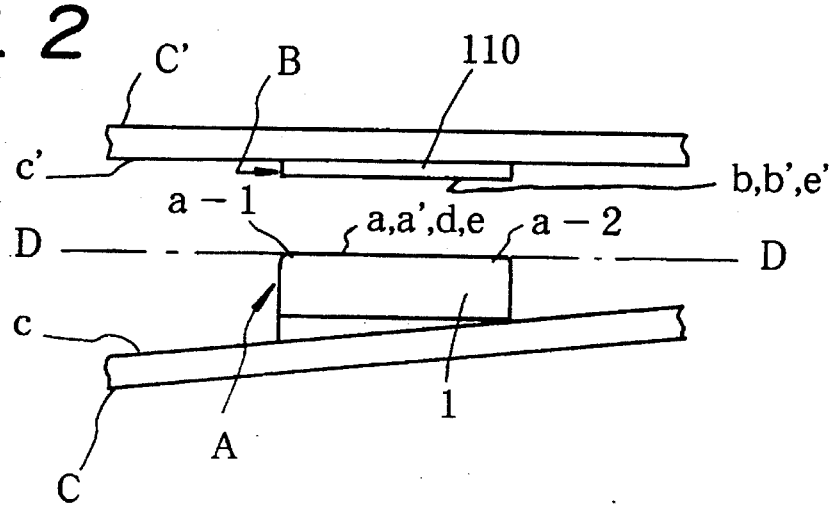
Figure 3:
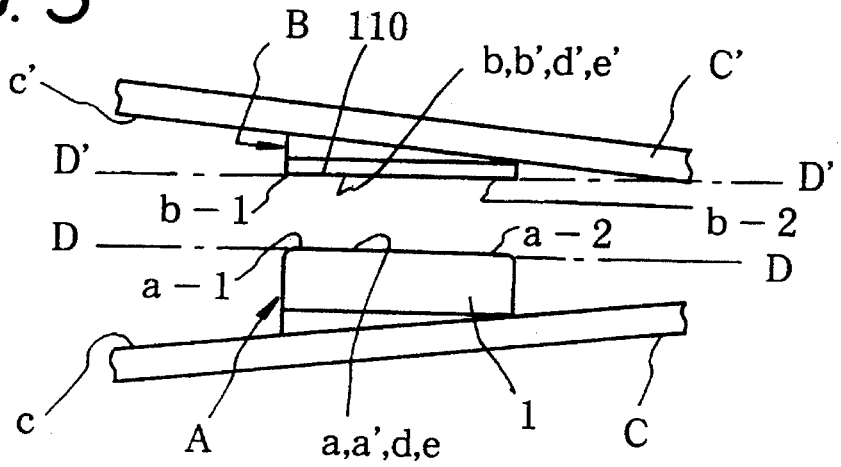

When the respective surfaces c and c' of the objects C and C' to which the members A and B are attached are not parallel as shown in FIGS. 1 through 3, the member B can be effectively attracted to the member A because the surfaces e and e' of the attraction surfaces a and b respectively of the members A and B are so constructed as to run parallel to each other when the members A and B are engaged.

In the first embodiment shown in FIG. 1, an insert or the like is provided between the member B and the object C' to which the member B is attached in order to tilt the member B so that the surfaces e and e' of the members A and B may run parallel to each other.

The fastener means according to the second embodiment shown in FIG. 2 also has an insert between the member A and the object C to which the former is attached so that the surfaces e and e' run parallel to each other.

The fastener means according to the third embodiment shown in FIG. 3 also includes an insert, etc. each between the members A and B and the objects C and C' respectively for tilting said members A and B so that the surfaces e and e' run parallel to each other.

In the fastener means according to Embodiments 1 through 3, an insert or the like means is used for tilting the members A and B in order for the surfaces a and h of the members A and B to run parallel to each other. However, the member(s) A and/or B themselves may be formed in such a manner that the surfaces e and e' are created between the two members without using an insert or the like for tilting the members A and B. For example, the inclined portion provided in the fastener means shown in FIG. 1 or 2 may be formed as an integral part of the attracting member A and/or attracted member B instead of using an insert. Alternatively still, the inclined portions and the means to tilt the members A and B provided in Embodiment 3 of FIG. 3 may be formed as integral parts of the members A and B by omitting such portions or means.

<Fastener Means According to the Second Invention>

The second invention will be described in terms of the fastener means according to Embodiments 1 through 3 shown in FIGS. 1 through 3 respectively.

The fastener means according to Embodiments 1 through 3 shown in FIGS. 1 through 3 are characterized in that the main attraction surface a' and/or b' of the attracting member A and/or the attracted member B include(s) a plane d and/or d' located on the virtual plane D and/or D' that intersect(s) the surface(s) c and/or c' of the object(s) C and/or C' to which the members c' and/or c are/is attached.

In the fastener means shown in FIG. 1, a means such as an insert is provided between the attracted member B and the object C' to which said member B is attached in order to create a surface d' within the virtual plane D' that intersects the surface c' of said object C'.

In the fastener means shown in FIG. 2, a means such as an insert is provided between the attracting member A and the object C to which the member A is attached in order to create a surface d within the virtual plane D that intersects the surface c of said object C.

Further in the fastener means shown in FIG. 3, means such as inserts are provided in between the attracting member A and the attracted member B and the objects C and C' to which said members A and B are attached to create surfaces d and d' on the virtual planes D and D' that intersect the surfaces c and c' of said objects C and C'.

Here, the virtual planes D and D' that intersect the surfaces c and c' of the objects C and C' mean a virtual plane which is assumed to exist in non-parallel relation with said surfaces c and c'.

"To include a plane that falls on the virtual plane" generally means that the plane which is on the same plane as virtual plane is included at least as a part of the main attraction surface a' or the main attracted surface b'. This in turn means that the main attraction surface a' or the main attraction surface b' of the member(s) A and/or B as a whole need not be on the virtual plane D or D'.

"The main attraction surface" here means the surfaces where the attraction force acts on the attracting member A and the attracted member B when the member B is attracted by the member A, and does not necessarily mean the entire surface where the two members A and B are in contact when attracted, or the surface where the two members are most strongly attracted to each other.

In a typical embodiment wherein said main attraction surface a' of the member A includes a plane d on the virtual plane D that intersects the surface c of the object C to which the member A is attached, a side portion a-1 and a side portion a-2 opposing the side a-1 are at least within the virtual plane D. In other words, it suffices when at least the side portion a-1 of the main attraction surface a' and the side portion a-2 opposite the side a-1 fall on said virtual plane D. While the portion between the side portion a-1 and the side portion a-2 opposite the side portion a-1 need not fall on the virtual plane D, it also goes without saying that said portion between a-1 and a-2 may also fall on the virtual plane D.

It is possible to construct the attracting member in such a manner that the entire periphery of the main attraction surface a' thereof falls on the virtual plane D. In this case, portions other than said entire periphery of the main attraction surface a' may and may not fall on the virtual plane D.

The attraction surface a of the attracting member A in its entirety or in part may be formed flat, concave, convex, projection, dent, conical projection, or conical dent, provided that the member A includes a plane which falls on the virtual plane D that intersects the surface c of the object C to which the member A is attached.

Description will now be made to embodiments of the attracted member B, in particular to the member B with the attraction surface b that includes a plane d' that falls on the virtual plane D' that in turn intersects the surface c' of the object C' to which the member B is attached.

In a typical example of an attracted member B of which attraction surface b' includes a plane d' that falls on the virtual plane D' that intersects the surface c' of the object C'at least one side portion b-1 of the main attraction surface b' in the attraction surface b of the member B and another side portion b-2 opposing said side portion b-1 constitute the plane d' which falls on the virtual plane D'.

So long as at least one side portion b-1 and the side portion b-2 opposing thereto in the main attraction surface b' constitute the plane d' falling on the virtual plane D', the portion in between the side portions b-1 and b-2 may assume any arbitrary shape such as convex and concave.

In this regard, the attracted member B may be so constructed that the entire periphery of the main attraction surface b' falls on the virtual plane D' that intersects the surface c' of the object C' to which the member B is attached. In this case, portions other than said entire periphery of the main attraction surface b' may and may not fall on the virtual plane D.

The attracted member B in its entirety or in part may be formed flat, concave, convex, projection, dent, conical projection, or conical dent, provided that the member B includes a plane d' which falls on the virtual plane D'.

<Fastener Means According to the Third Invention>

Embodiments according to the third invention will now be described referring to FIGS. 4 through 6. Component parts and constructional features identical with those of the embodiments shown in FIGS. 1 through 3 are given the same reference numbers and the explanation is omitted.

Figure 4:
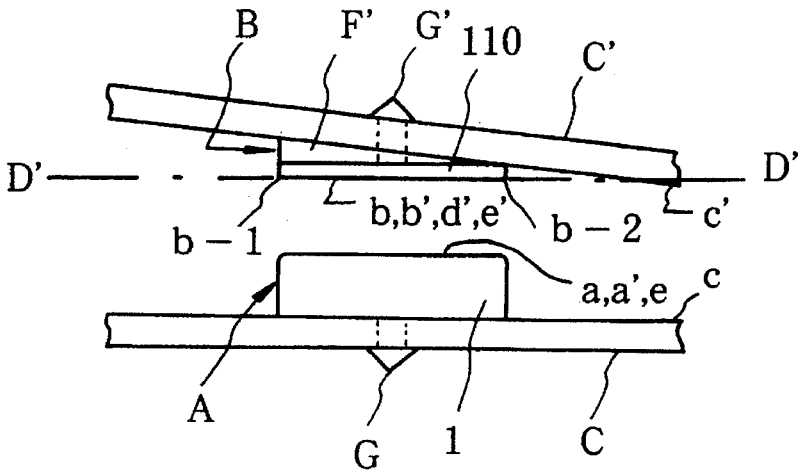
Figure 5:
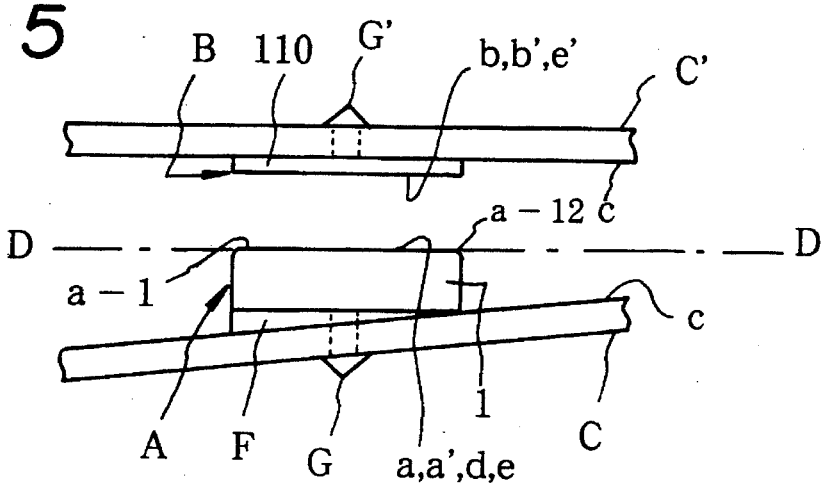
Figure 6:
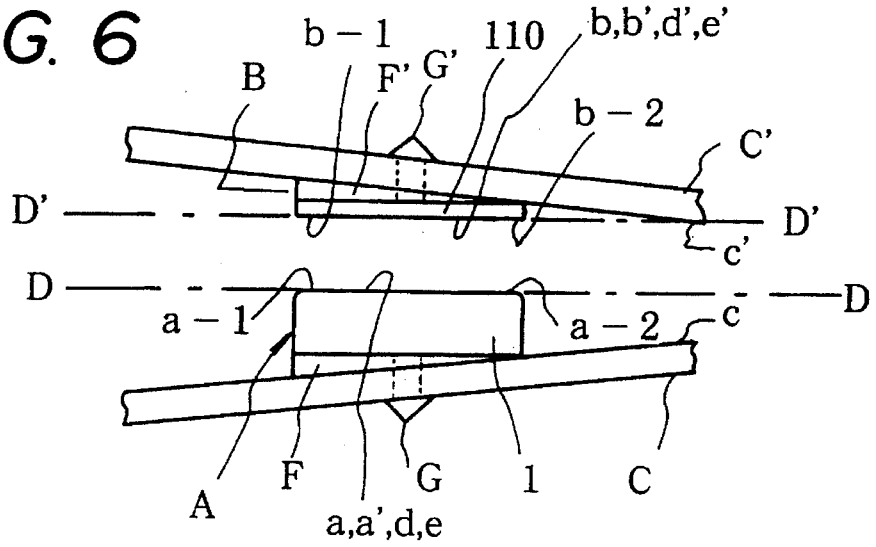

Embodiments 4 through 6 shown in FIGS. 4 through 6 respectively comprise an attracting member A with a permanent magnet 1 and a member B provided with a ferromagnetic element 110 to be attracted by said member A and are characterized in that said members A and B are attached respectively to the surfaces c and c' of a pair of objects C and C' to face each other. Either one or both of the members A and/or B are attached to said surfaces c and c' with an inclination.

The attracting member A further comprises a fixing means G to fix the member A to the object C, and a tilting means F to incline the member A with respect to the surface c of the object C. It is noted that the fixing means G may be of any type so long as it is capable of fixing the member A to the object C. It may be formed as an integral part of the member A; alternatively, an independent fixing means may be used. The attracting member A may be directly or indirectly fixed to the object C by adhesion or by using a double-coated tape. The tilting means E may also be of any type so long as it is capable of inclining the member A with respect to the object C. For example, a projection may be provided on a ferromagnetic element (not shown) which is on the opposite side from the attraction surface a of the member A. The tilting means can be formed as a projection pointing toward the surface c of the object C from a ferromagnetic element (not shown) provided opposite the surface a. The tilting means may also be formed as a projection (not shown) projected from said fixing means G and pointing toward the surface c of the object C.

The attracted member B further comprises a fixing means G' to fix the member B to the object C', and a tilting means F' to incline the member A with respect to the surface c' of the object C'. It is noted that the fixing means G' may be of any type so long as it is capable of fixing the member B to the object C'. It may be formed as an integral part of the member B; alternatively, an independent fixing means may be used. The member B may be directly or indirectly fixed to the object C' by adhesion or by using a double-coated tape. The tilting means F' may also be of any type so long as it is capable of inclining the member B with respect to the object C'. For example, a projection (not shown) may be provided on a ferromagnetic element of the member B so that the projection points toward the surface G' of the object C'. It is also possible that a projection (not shown) may project from the fixing means G' toward the surface c'.

In the fastener means according to Embodiment 4 shown in FIG. 4, the attracted member B is fixed to the object C' by means of the fixing means G' with the tilting means F' interposed therebetween.

In Embodiment 5 shown in FIG. 5, the attracting member A is fixed to the object C by means of the fixing means G with the tilting means F interposed therebetween.

In Embodiment 6 shown in FIG. 6, the attracting member A and the attracted member B are respectively fixed by means of the fixing means G and G' with the tilting means E and F' interposed to incline the members A and B with respect to the objects C and C' respectively.

The most typical attracting member A and the attracted member B representing Embodiments 1 through 6 shown in FIGS. 1 through 6 have been described. In Embodiments 1 through 6, the attracting member A effectively attracts the attracted member B even when the surfaces c and c' of the objects C and C' to which the members A and B are attached are not parallel with each other, i.e. when the surfaces c and c' fall on planes that intersect with each other, as the attraction force of the permanent magnet in the member A effectively acts to facilitate the attraction of the member B by the member A.

As a result, the attraction between the members A and B brings the objects C and C' to be fastened by the attraction of the members A and B held stably in contact without the male and female members being inadvertently detached by external impact, etc.

<Examples of Specific Application of the Fastener Means>

Figure 7:
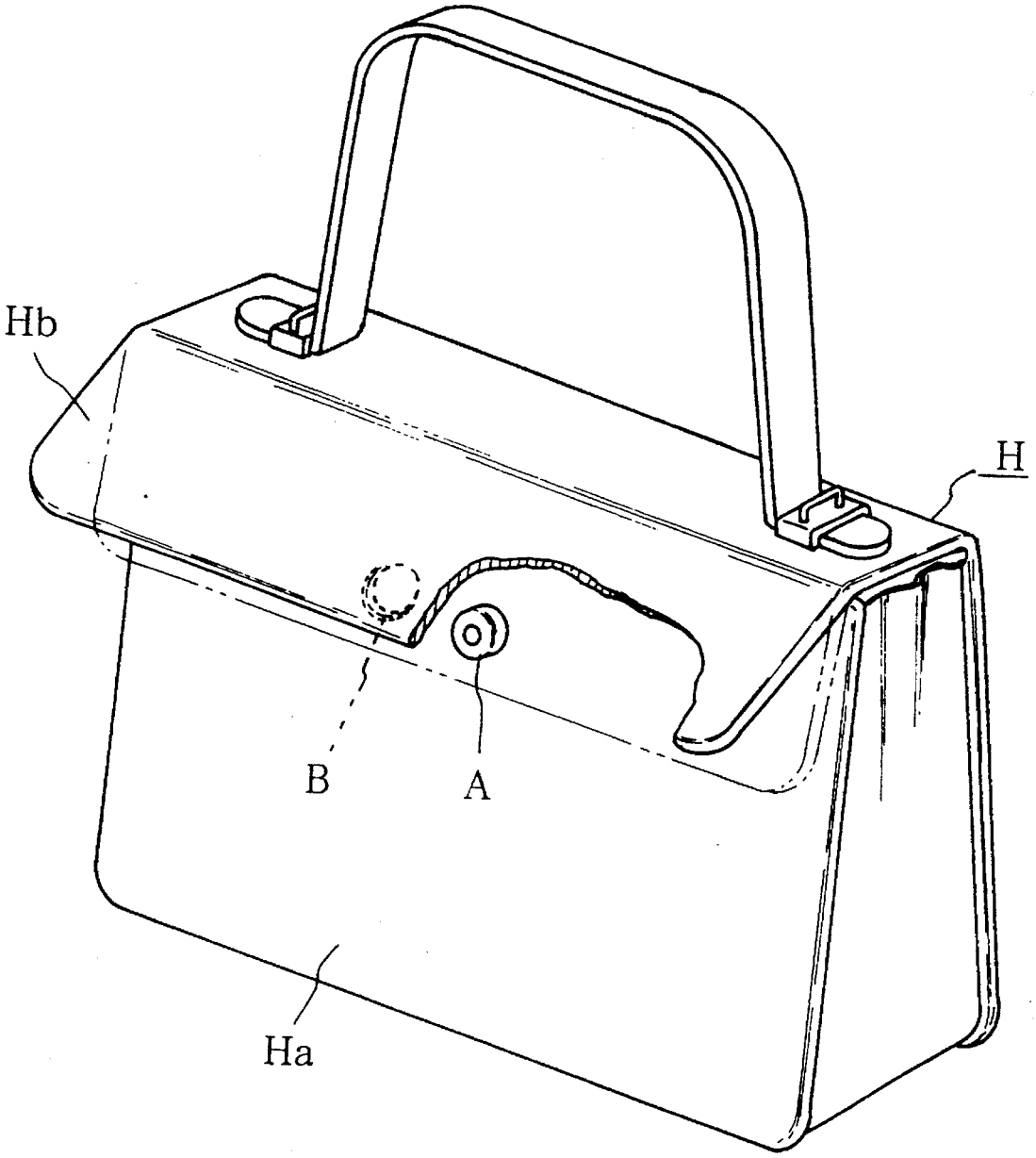
FIGS. 7 and 8 show how the fastener means of FIGS. 1 through 6 and FIGS. 9 through 15 can be attached to a handbag.
Figure 8:
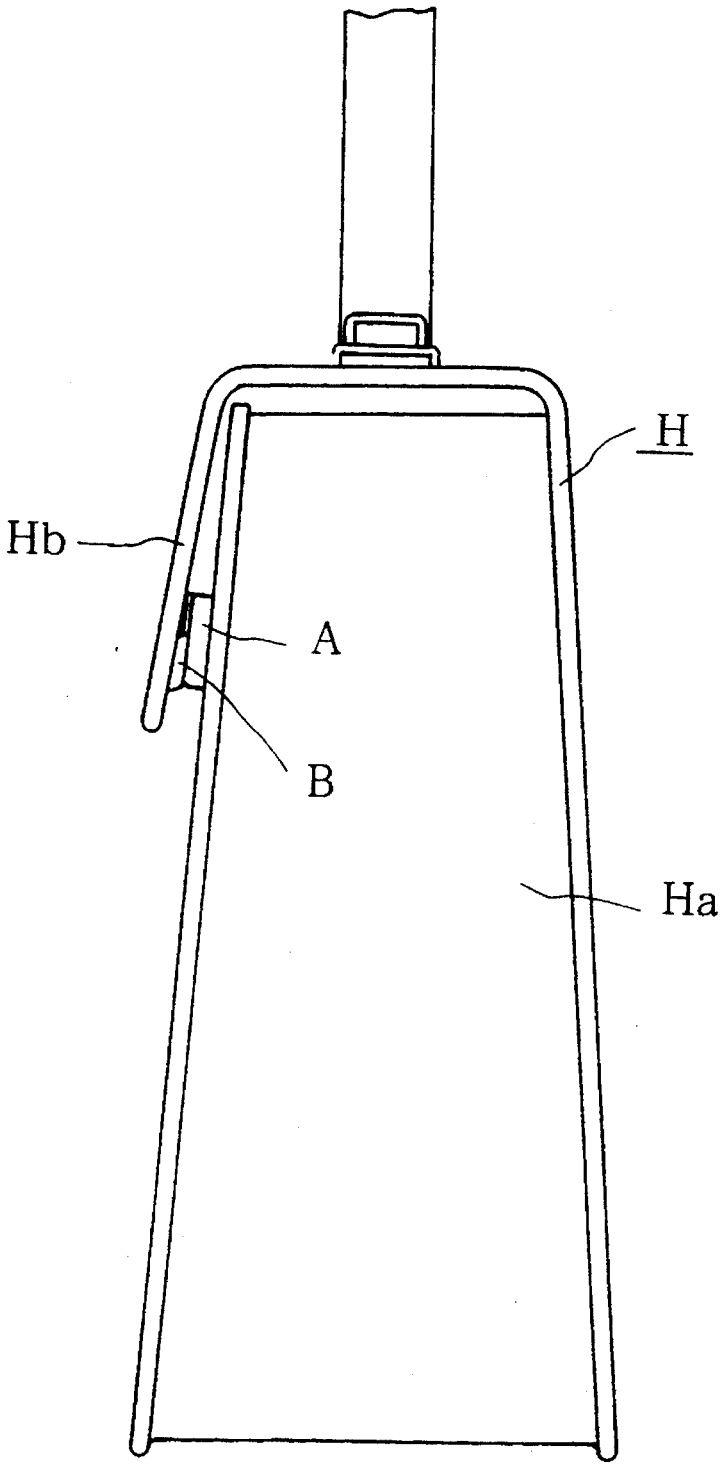

FIGS. 7 and 8 show the attracting member A and the attracted member B attached to a handbag H, the member A being attached to the body Ha and the member B to the cover Hb of the handbag H respectively.

As is clear from the example shown, the cover Hb of a handbag H in general closes the body Ha at a given angle with respect to the body Ha. Also, a force is usually working on the cover Hb to move it away from the body Ha whenever the attraction between the members A and B is released. As a result, the attraction surfaces of the members A and B each face a direction that would cause the surfaces to intersect with each other, disadvantageously causing insecure attraction between two members when the cover Hb is closed.

By attaching a fastener means according to any one of Embodiments described above to the handbag M shown in FIGS. 7 and 8, the cover Hb is securely and stably held attracted to the body Ha despite the structure of the handbag M which otherwise causes the attraction surfaces to intersect with each other.

It is noted that in the figures, the attracted member B is attached on the cover Hb and the attracting member A on the body Ha respectively of the handbag H, but the attachment relation may be reversed. It is also noted that although the cover Hb shown in the figure is bent at an angle so that its tip edge opens from the body Ha, the cover Hb may be bent at an angle that would cause its tip end to close on the body Ha. The fastener means according to the present invention can be attached to any handbag wherein the cover Hb and the body Ha each face a direction that would intersect with each other.

The fastener means according to Embodiments 1 through 6 may be applicable not only to the handbag M shown in FIGS. 7 and 8 but to any bags, sacks or boxes that have a cover, as a means to hold the cover in place when closed. By attaching the members A and B on the inside of the opening of a bag, sack, etc. opposingly, such opening can be held closed. Said fastener means can be used to close the door to a cabinet or an entrance. It can also be used to connect various types of strips, bands or belts for coats, etc.

<Specific Examples of the Fastener Means>

Specific examples of the fastener means shown in FIGS. 9 through 15 will now be described. For convenience, fastener means shown in FIGS. 9 through 15 are described as specific examples 1 and 2 to distinguish them from the basic' embodiments shown in FIGS. 1 through 6.

In the following description, identical or substantially identical component parts of the specific example and the embodiments in FIGS. 1 through 6 are given the same reference numbers and repetitive explanation is omitted.

<Fastener Means of Specific Example 1>

FIGS. 9 through 13 show a fastener means of Specific Example 1.

The fastener means comprises an attracting member A and an attracted member that are attached to a pair of objects with their attraction surfaces a and b facing each other. The pair of objects C and C' each have a fixing surface c and c' that intersect each other when the members A and B are attracted.

The attracting member A includes a permanent magnet 1 having a through-hole 1*c* extending between the N pole and the S pole, or between one magnetic polar surface 1*a* and another such polar surface 1*b;* a ferromagnetic element 10 comprising a ferromagnetic plate 2 provided on the magnetic polar surface 1*b* and a ferromagnetic rod 4 that penetrates the ferromagnetic plate 2 and the through-hole 1*c* of the permanent magnet 1; an anchor means 6 acting as a fixing means G that comprises a seat plate 6*b* provided with pair of legs 6*a* and 6*a;* and a case 7. A ferromagnetic rod 4 having a thicker portion 4*b* and a thinner portion 4*a* is inserted at said thinner portion 4*a* into a hole 2*a* provided in the ferromagnetic plate 2 and further into a hole 6*c* of the anchor means 6 attached to the plate 2. The thinner portion 4*a* projecting out of the hole 6*c* is compressed as the thicker portion 4*b* abuts against the plate 2 to thereby assemble the plate 2 and the anchor means 6 integrally by means of the rod 4. The case 7 includes a crown 7*c*, a hole 7*b* in the crown, a rim 7*a* extending from the hole 7*b* toward the inside of the hole 1*c* of the permanent magnet 1, and a side wall 7*d* with catches 7*e* to be bent at the bottom.

The permanent magnet 1 is placed inside the case 7 with the magnetic polar surface la abutting against the inner face of the crown 7*c*. The ferromagnetic rod 4 attached to the ferromagnetic plate 2 is inserted in the hole 1*c* with the plate 2 resting against the surface 1*b* of the permanent magnet 1. The ferromagnetic member 10 is thus placed inside the case 7, and the catches 7*e* of the latter are bent over the outer surface of the plate 2 constituting a part of the member 10 thus housed inside the case 7. The entire assembly constitutes the attracting member A.

The attracted member B includes a ferromagnetic element 110 comprising a ferromagnetic plate 101 to be attracted by the member A and a ferromagnetic rod 102 to be attached to said plate 101, and an anchor means 104 that acts as a fixing means to fix the member B to the object C'. A ferromagnetic rod 102 comprising a thicker portion 102*b* and a thinner portion 102*a* is inserted at its thinner portion 102*a* into a hole 104*c* of the anchor means 104 attached to the plate 101, and with the portion 102*b* abutting against the plate 101, the thinner portion 102*a* projecting out of the hole 104*c* is compressed to assemble the component parts integrally into one member. The anchor means 104 includes a seat plate 104*b*, and a pair of opposing legs 104*a* and 104*a* bent from the plate 104*b*, the hole 104*c* being bored substantially at the center of the plate 104*b*.

The attracted member B of the above construction is further provided with a tilting means F' to tilt the member B with respect to the fixing surface c' of the object C'. A projection 103 is provided on the ferromagnetic plate 101 of the ferromagnetic member 110 as such tilting means F' in this specific example. The projection 103 provided on the ferromagnetic plate 101 causes the attraction surface b of the attracted member B to fall on a plane d' on a virtual plane D' that intersects the surface c' of the object C' when the member B is attached to said object C'. Because of presence of the tilting means F', the attraction surfaces a and b of the members A and B fall on parallel planes e and e' even when the surfaces c and c' to which the members A and B are attached are not parallel. The projection 103 is therefore an integral part of the ferromagnetic plate 101 bent toward the fixing surface c' of the object C', or toward the opposite direction from the attraction surface b of the member B.

In the example shown in the figure, the projection 103 is formed by bending the circumferential edge of the disc-like ferromagnetic plate 101 substantially halfway the circumference, with the height of the projection gradually increasing from both sides toward the mid point where it becomes the highest. It is understood, however, that the projection may assume any form so long as the member B is tilted with respect to the fixing surface c' of the object C'. Instead of a crescent form as shown in the figure, the projection may be a plain plate-like member, or it may be an annular member erected from the entire circumference of the plate 101.

The permanent magnet 1 used in this specific example may include any magnetic material such as alnico magnet, Ba-ferrite magnet and rare-earth magnet. All types of material that are called permanent magnet-such as plastic moldings or rubber moldings having magnetism and containing hard powder of magnetic material such as Ba-ferrite may also be used.

The ferromagnetic member, ferromagnetic plate and ferromagnetic rod used in the specific examples generally mean materials that have the property to be attracted by said permanent magnet 1, and they typically include iron, cobalt, nickel and alloys thereof, as well as stainless steel materials with a property to be attracted by a permanent magnet.

When the attracting member A and the attracted member B are attracted at their attraction surfaces a and b, the ferromagnetic rod 102 of the member B is attracted to the ferromagnetic rod 4 within the hole 3 of the member A which is constituted by the hole 1*c* of the permanent magnet 1 and the hole 7*b* of the case 7. As a result, magnetism of the permanent magnet 1 is taken into the magnetic path that passes through the ferromagnetic plate 2 on the magnetic polar surface 1*b*, the ferromagnetic rod 4 provided on this plate 2, ferromagnetic rod 102 and the ferromagnetic plate 101 respectively of the member B, whereby strong attraction force is generated on the contact surface of the ferromagnetic rod 4 with the rod 102.

The case 7 constituting the attracting member A may be of any non-magnetic material such as brass and plastic. Ferromagnetic materials such as iron may also be used for the case 7 in order to prevent magnetic leakage from the permanent magnet 1.

FIGS. 11 through 13 show the fastener means according to Specific Example 1 as attached to the objects C and C'. Here, the object C is the body of a handbag comprising a hard core material 200 such as cardboard and a face material 201 such as leather attached to the core material 200 on the side to which the member A is to be fixed. To fix the member A to the object C, the legs 6*a* of the anchor means 6 are first inserted into slits bored in the face and the core materials 201 and 200, further inserted into hole 8*a* of a washer 8 and bent. A lining 202 is then placed over the core material 200, covering the washer 8. To fix the member B to the object C', which in this case is the cover of a handbag comprising an inner face material 203 such as leather and a hard core material 204 to which said face material 203 is attached, the legs 104*a* of the anchor means 104 of the member B are inserted in the slits formed on the face and the core materials 203 and 204, further into a hole 105*a* of a washer 105 and bent. An outer face material 206 is then placed over a cushion material 205 such as urethane foam, which in turn is placed over the core material 204.

In this specific example having the above construction, the attraction surfaces a and b fall on the parallel planes e and e' when the member B is attracted by the member A, so that secure and stable attraction between the two members is achieved even if the surfaces c and c' to which the members A and B are attached are not parallel. Moreover, as the main attraction surface b' of the member B contains a plane d' within the virtual plane D' that intersects the surface c' to which the member B is attached, the plane d' can be securely attracted to the surface a of the member A even when the members A and B are attached to the surfaces c and c' that are not parallel to each other.

Because of the projection 103 of the member B, the attraction surface b thereof is tilted with respect to the surface c' of the object C', such that the attraction surface b of the member B is securely attracted to the surface a of the member A even when the opposing surfaces c and c' of the objects C and C' to which the members A and B are fixed are not parallel.

<Fastener Means of Specific Example 2>

FIGS. 14 and 15 show the specific example 2 of the fastener means.

In this example, the construction is identical or substantially identical to that of the specific example 1 except that the ferromagnetic plate 101 of the member 110 in the member B is formed as a disc, and that a projection 5 is provided on the ferromagnetic plate 2 of the ferromagnetic member 10 in the member A. That is, the projection 5 provided on the ferromagnetic plate 2 in the member A causes the member A to be fixed to the object C in a tilted manner. As the projection 5 functions as a tilting means E that inclines the member A with respect to the surface c, the attraction surface a and more particularly the main attraction surface a' of the member A can contain a plane d within the virtual plane D that intersects the surface c of the object C. Because of the tilting means F, the attraction surfaces a and b of the members A and B contain planes e and e' that are parallel to each other even when the surfaces c and c' to which the members A and B are attached are not parallel when said two members are attracted to each other.

The projection 5 therefore projects from the circumference of the disc-like ferromagnetic plate 2 toward the object C. The height of the projection reaches the maximum at its mid point and gradually tapers off on both sides.

Similarly as in the specific example 1, the ferromagnetic member 10 having the ferromagnetic plate 2 and the ferromagnetic rod 4 is housed inside the case 7 with the catches 7*e* of the case 7 bent toward the plate 2 of the member 10. The catches 7*e* are therefore located at positions where they do not get in the way of the projection 5.

The specific example 2 is identical or substantially identical in construction with the specific example 1 except for those points mentioned above, may be attached to the same types of object by an identical method, and may function in the same manner as the specific example 1. Repetitive explanation is therefore omitted.

These specific examples are explained by way of illustrative examples; the construction and shape of the component parts or method of assembling or fixing the same, etc. are in no way limited by these examples.

Instead of using the ferromagnetic rod 4 of the ferromagnetic member 10 in the member A, the ferromagnetic rod 102 of the ferromagnetic member 110 in the member B may be directly attracted to the ferromagnetic plate 2 of the member A. Conversely, the ferromagnetic rod 4 extending the plate 2 can be directly attracted or brought close to the ferromagnetic plate 101 of the member B.

It is possible to fix the ferromagnetic member 10 directly to the permanent magnet 1 instead of using the case 7 for the member A. For example, the ferromagnetic rod 4 of the ferromagnetic member 10 can be pressed into the hole 1*c* of the permanent magnet 1 which is made of a plastic magnet.

It is noted that although the attraction surfaces of the members A and B are made flat in the foregoing description, whole or part of such surfaces may include at least one portion which is flat, dented, projected, curved as convex or concave, or conical dent or projection. The attraction surfaces of the members A and B may be in contact with each other in parts and not necessarily as a whole. The members A and B need not include surfaces which are parallel to each other over their entirety so long as a portion each of their respective attraction surfaces are parallel to each other. Such parallel surfaces may be flat, inclined, curved or any other form so long as they are parallel. Combination of such surfaces may also be used.

The members A and B each contain, as a part of their respective main attraction surfaces, a plane within the virtual plane D that intersects the surfaces of the objects to which the members are attached. The entire attraction surfaces need not fall on the virtual plane D. Thus, for example, the attraction surfaces of the members A and B may be so constructed that at least one side of either one of the members and one side of the other member opposing said side of the first member fall on the virtual plane. Alternatively, the entire peripheral side of the attraction surface of either the member A or B may be formed as a surface which falls on the virtual plane.

The attraction surfaces of the members A and B other than the main attraction surfaces that are constructed to fall on the virtual plane can be formed in any arbitrary shape such as flat, curved, dented or projected.

As a means to tilt the member A or B, a projection is extended from the ferromagnetic member toward the object to which the member A or B is attached, but it is also possible, for example, that said projection is extended from a fixing means with which the member A or B is attached to the object to face the surface of the latter. Instead of using such ferromagnetic member or fixing means, a separate means may be attached to the fixing surface of the member A or B to tilt the same with respect to the object.

Further, a wall may be provided on the periphery of the attraction surface of the member A. The member A may include a flat surface having said hole 3, or a slanted or curved surface upwardly and/or downwardly sloping toward the hole 3.

The member B may include a flat surface, a slanted surface or curved surface upwardly and/or downwardly sloping toward a portion where the ferromagnetic rod is provided or to a portion that corresponds to the hole 3 of the member A.

The anchor means 6 and 104 may be any means so long as they are capable of fixing the members A and B to the objects C and C' respectively.

The projections 5 and 103acting as the tilting means F and F' for the members A and B respectively may be of any construction or shape so long as they are capable of tilting the members A and B with respect to the objects C and C' to thereby create surfaces e and e' on the members A and B that are parallel to each other, or, create planes d and d' on the main attraction surfaces a' and b' of the members A and B, the planes d and d' being contained within the virtual planes D and D' that intersect said main attraction surfaces a' and b'. They may be formed as separate members from the ferromagnetic plates 2 and 101. The members A and B may both be provided with such tilting means F and F' at the same time.

The fastener means of the aforementioned construction according to the present invention is characterized in that the attraction surfaces a and b of the members A and B contain planes e and e' that run parallel to each other when the members A and B are attracted, so that even when the fastener means comprising the attracting member A and attracted member B are attached to the objects C and C' of which surfaces c and c' for fixing the members A and B are not parallel, and that said parallel planes e and e' allow secure attraction between the two members.

Moreover, since the attraction surface a or b of the member A or B includes the plane d or d' within the virtual plane D or D' that intersects the fixing surface c or c', or since the main attraction surfaces a' and b' of the members A and B include planes within the Virtual plane D and D' that intersect the fixing surfaces c and c' of the object C and C' the plane d of the member A within the virtual plane D attracts the attraction surface b of the member B, or the plane d' of the member B within the virtual plane D is attracted to the surface a of the member A, or the planes d and d' within the virtual planes D and D' are conveniently attracted to each other, in accordance with the angle with which the planes D and D' intersect the surfaces c and c' even if the opposing surfaces c and c' of the objects C and C' to which the members A and B are attached are not parallel.

Still further, as the members A and/or B are tilted with respect to the objects C and/or C' when they are attached thereto, the members A and B are effectively attracted to each other in accordance with the inclination of the members A and/or B against the objects C and/or C' even if the opposing surfaces, c and c' of the objects C and C' to which the members A and B are attached are not parallel.

What is claimed is:

1. A fastener means comprising an attracting member having a permanent magnet and an attracted member having a ferromagnetic element to be attracted by said attracting member and a member disposed between the attracting member and one of a pair of objects or between the attracted member and the other of the pair of objects such that, when the attracting member and the attracted member are respectively fixed to the pair of objects and when fixing surfaces of said objects are not parallel, the attracting member and the attracted member run parallel to each other when the attracting member and the attracted member are attracted to each other.

2. A fastener means comprising an attracting member having a permanent magnet and an attracted member having a ferromagnetic element to be attracted by said attracting member, characterized in that the attracting and attracted members are fixed to fixing surfaces on a pair of objects, and that attraction surfaces of the attracting member and attracted member are disposed on a plane which intersects at least one fixing surfaces of the objects, wherein a separate tilting member is disposed between the attracting member and one of the fixing surfaces or between the attracted member and the other fixing surface.

3. A fastener means comprising an attracting member having a permanent magnet and an attracted member having a ferromagnetic element to be attracted by said attracting member, characterized in that the attracting and the attracted members are fixed to respective fixing surfaces of a pair of objects, wherein a separate tilting member is disposed between the attracting member and one of the fixing surfaces or between the attracted member and the other fixing surface.

4. The fastener means as claimed in any one of claim 1, 2, or 3 wherein:

said attracting member comprises one magnetic polar surface on the side where it attracts the attracted member and the other magnetic polar surface on the side where it faces the object to which it is fixed, a permanent magnet with a hole that extends between said magnetic poles, and a second ferromagnetic element provided on the side of the magnetic pole where it faces the object to which the attracting member is to be attached;

and the second ferromagnetic element of the attracting member and the ferromagnetic element of the attracted member are attracted to each other within said hole in the permanent magnet.

5. A fastener means comprising an attracting member having a permanent magnet and an attracted member having a ferromagnetic element to be attracted by said attracting member, wherein when the attracting member and the attracted member are respectively fixed to one of a pair of nonparallel objects, the attraction surfaces of the attracting member and the attracted member run parallel to each other when the attracting member and the attracted member are attracted to each other; and wherein said attracting member comprises one magnetic polar surface on the side where it attracts the attracted member and the other magnetic polar surface on the side where it faces the object to which it is fixed, a permanent magnet defining a hole extending between said magnetic poles, and a second ferromagnetic element provided on the side of the magnetic pole where it faces the object to which the attracting member is to be attached; and wherein said second ferromagnetic element of the attracting member and the ferromagnetic element of the attracted member are attracted to each other within said hole in the permanent magnet.

6. A fastener means comprising an attracting member having a permanent magnet and an attracted member with a ferromagnetic element to be attracted by said attracting member, wherein the attracting and attracted members are disposed on fixing surfaces on a pair of objects, and wherein the attraction surfaces of the attracting member and attracted member are disposed on a plane which intersects the fixing surfaces of the objects; and wherein said attracting member comprises one magnetic polar surface on the side where it attracts the attracted member and the other magnetic polar surface on the side where it faces the object to which it is fixed, a permanent magnet defining a hole extending between said magnetic poles, and a second ferromagnetic element provided on the side of the magnetic pole where it faces the object to which the attracting member is to be attached; and wherein said second ferromagnetic element of the attracting member and the ferromagnetic element of the attracted member are attracted to each other within said hole in the permanent magnet.

7. A fastener means comprising an attracting member having a permanent magnet and an attracted member having a ferromagnetic element to be attracted by said attracting member, wherein the attracting and the attracted members are fixed to respective fixing surfaces of a pair of objects, and that one of the attracting member and the attracted member is fixed to the respective objects with an inclination; and wherein said attracting member comprises one magnetic polar surface on the side where it attracts the attracted member and the other magnetic polar surface on the side where it faces the object to which it is fixed, a permanent magnet defining a hole extending between said magnetic poles, and a second ferromagnetic element provided on the side of the magnetic pole where it faces the object to which the attracting member is to be attached; and wherein said second ferromagnetic element of the attracting member and the ferromagnetic element of the attracted member are attracted to each other within said hole in the permanent magnet.

* * * * *